US006889183B1

(12) United States Patent
Gunduzhan

(10) Patent No.: US 6,889,183 B1
(45) Date of Patent: May 3, 2005

(54) APPARATUS AND METHOD OF REGENERATING A LOST AUDIO SEGMENT

(75) Inventor: Emre Gunduzhan, Rockville, MD (US)

(73) Assignee: Nortel Networks Limited (CA)

( * ) Notice: Subject to any disclaimer, the term of this patent is extended or adjusted under 35 U.S.C. 154(b) by 0 days.

(21) Appl. No.: 09/353,906

(22) Filed: Jul. 15, 1999

(51) Int. Cl.[7] ..... G10L 11/04

(52) U.S. Cl. ..... 704/207; 704/205

(58) Field of Search ..... 704/205, 207

(56) References Cited

U.S. PATENT DOCUMENTS

| | | | | | |
|---|---|---|---|---|---|
| 5,390,362 | A | * | 2/1995 | Modjeska et al. | 455/38.1 |
| 5,699,485 | A | * | 12/1997 | Shoham | 341/94 |
| 5,706,392 | A | * | 1/1998 | Goldberg et al. | 704/219 |
| 5,774,837 | A | * | 6/1998 | Yeldener et al. | 704/208 |
| 5,890,108 | A | * | 3/1999 | Yeldener | 704/208 |
| 6,009,384 | A | * | 12/1999 | Veldhuis et al. | 704/201 |
| 6,026,080 | A | * | 2/2000 | Roy | 370/260 |
| 6,041,297 | A | * | 3/2000 | Goldberg | 704/219 |
| 6,499,060 | B1 | * | 12/2002 | Wang et al. | 709/231 |

OTHER PUBLICATIONS

Erklens et al, "LPC Interpolation by Approximation of the Sample Autocorrelation Function", 1998 IEEE, pp 569–572.*

Melih et al, "Audio Source Type Segmentation Using a Perceptually Based Representation", ISSPA 1999.*

Cluver, K. and Noll, P., "Reconstruction of Missing Speech Frames Using Sub–Band Excitation", IEEE–SP Int'l Symposium on Time–Scale Analysis, Jun. 1996.

Cluver, K., "An ATM Speech Codec with Improved Reconstruction of Lost Cells", EUSIPCO–96, Trieste, Italy, Sep. 1996.

"Missing Packet Recovery Techniques for Low–Bit–Rate Coded Speech," IEE Journal on Selected Areas in Communications, vol. 7, No. 5, Jun. 1989, Junji Suzuki and Masahiro Taka, pp. 707–717.

"Recovery of Missing Speech Packets Using the ShortTime Energy and Zero–Crossing Measurements," IEE Transactions on Speech and Audio Processing, vol. 1, No. 3, Jul. 1993, Nurgün Endöl, Claude Castellaccua, and Ali Zilouchian, pp. 295–303.

"Audio Video Transport WG," Internet Engineering Task Force, Internet Draft, J. Rosenberg, H. Schulzrinne, Bell Laboratories, Columbia U., Nov. 10, 1998, pp. 1–17.

"RTP Payload for Redundant Audio Data," Internet Draft, Perkins, et al., Aug. 3, 1998, pp. 1–10.

"Model–Based Multirate Representation of Speech Signals and Its Application to Recovery of Missing Speech Packets," IEE Transactions on Speech and Audio Processing, vol. 5, No. 3, May 1997, You–Li Chen and Bor–Sen Chen, pp. 220–231.

"Waveform Substitution Techniques for Recovering Missing Speech Segments in Packet Voice Communications," IEE Transactions on Acoustics Speech and Signal Processing, vol. ASSP–34, No. 6, Dec. 1986, pp. 1440–1448.

"A High Quality Low–Complexity Algorithm for Frame Erasure Concealment (FEC) with G.711," AT&T Labs—Research, Study Period 1997–2000, David A. Kapilow, Richard V. Cox, May 17–28, 1999.

* cited by examiner

*Primary Examiner*—Susan McFadden
*Assistant Examiner*—Michael N. Opsasnick
(74) *Attorney, Agent, or Firm*—Steubing McGuinness & Manaras LLP

(57) ABSTRACT

A method and apparatus for generating a new audio segment that is based upon a given audio segment of an audio signal first locates a set of consecutive audio segments in the audio signal. The located set of audio segments precede the given audio signal and have a formant. The formant then is removed from the set of audio signals to produce a set of residue segments having a pitch. The pitch and set of residue segments then are processed to produce a new set of residue segments. Once produced, the formant of the consecutive audio segments is added to the new set of residue segments to produce the new audio segment. The audio signal includes a plurality of audio segments.

28 Claims, 4 Drawing Sheets

APPARATUS AND METHOD OF REGENERATING A LOST AUDIO SEGMENT

FIELD OF THE INVENTION

The invention generally relates to data transmission networks and, more particularly, the invention relates to regenerating an audio signal segment in an audio signal transmitted across a data transmission network.

BACKGROUND OF THE INVENTION

Network devices on the Internet commonly transmit audio signals to other network devices ("receivers") on the Internet. To that end, prior to transmission, a given audio signal commonly is divided into a series of contiguous audio segments that each are encapsulated within one or more Internet Protocol packets. Each segment includes a plurality of samples that identify the amplitude of the signal at specific times. Once filled with one or more audio segments, each Internet Protocol packet is transmitted to one or more Internet receiver(s) in accord with the well known Internet Protocol.

As known in the art, Internet Protocol packets commonly are lost during transmission across the Internet. Undesirably, the loss of Internet Protocol packets transporting audio segments often significantly degrades signal quality to unacceptable levels. This problem is further exasperated when transmitting a real-time voice signal across the Internet, such as a real-time voice signal transmitted during a teleconference conducted across the Internet.

SUMMARY OF THE INVENTION

In accordance with one aspect of the invention, a method and apparatus for generating a new audio segment that is based upon a given lost audio segment ("given segment") of an audio signal first locates a set of consecutive audio segments in the audio signal. The located set of audio segments precede the given audio segment and have a formant. The formant then is removed from the set of audio segments to produce a set of residue segments having a pitch. The pitch and set of residue segments then are processed to produce a new set of residue segments. Once produced, the formant of the consecutive audio segments is added to the new set of residue segments to produce the new audio segment. The audio signal includes a plurality of audio segments. The above noted formant may include a plurality of variable formants.

In preferred embodiments, the given audio segment is not ascertainable, while its location within the audio signal is ascertainable. The audio signal may be any type of audio signal, such as a real-time voice signal transmitted across a packet based network. Among other things, the audio signal in such case may be a stream of data packets. The pitch of the set of residue segments may be determined to generate the audio segment. In some embodiments, the formant is removed by utilizing linear predictive coding filtering techniques. In a similar manner, the pitch and set of residue segments may be processed by utilizing such linear predictive coding filtering techniques.

The formant preferably is a variable function that has a variable value across the set of audio segments. Overlap-add operations may be applied to the new audio segment to produce an overlap new audio segment. In further embodiments, the overlap new audio segment may be scaled to produce a scaled overlap new audio segment. The scaled overlap new audio segment thus replaces the previously noted new audio segment and thus, is a final new audio segment. Once produced, the final new segment is added to the audio signal in place of the given audio segment. In preferred embodiments, the set of consecutive audio segments immediately precede the given audio segment. Stated another way, in this embodiment, there are no audio segments between the set of consecutive audio segments and the given audio segment.

Preferred embodiments of the invention are implemented as a computer program product having a computer usable medium with computer readable program code thereon. The computer readable code may be read and utilized by the computer system in accordance with conventional processes.

BRIEF DESCRIPTION OF THE DRAWINGS

The foregoing and other objects and advantages of the invention will be appreciated more fully from the following further description thereof with reference to the accompanying drawings wherein.

DESCRIPTION OF PREFERRED EMBODIMENTS

Figure 1:
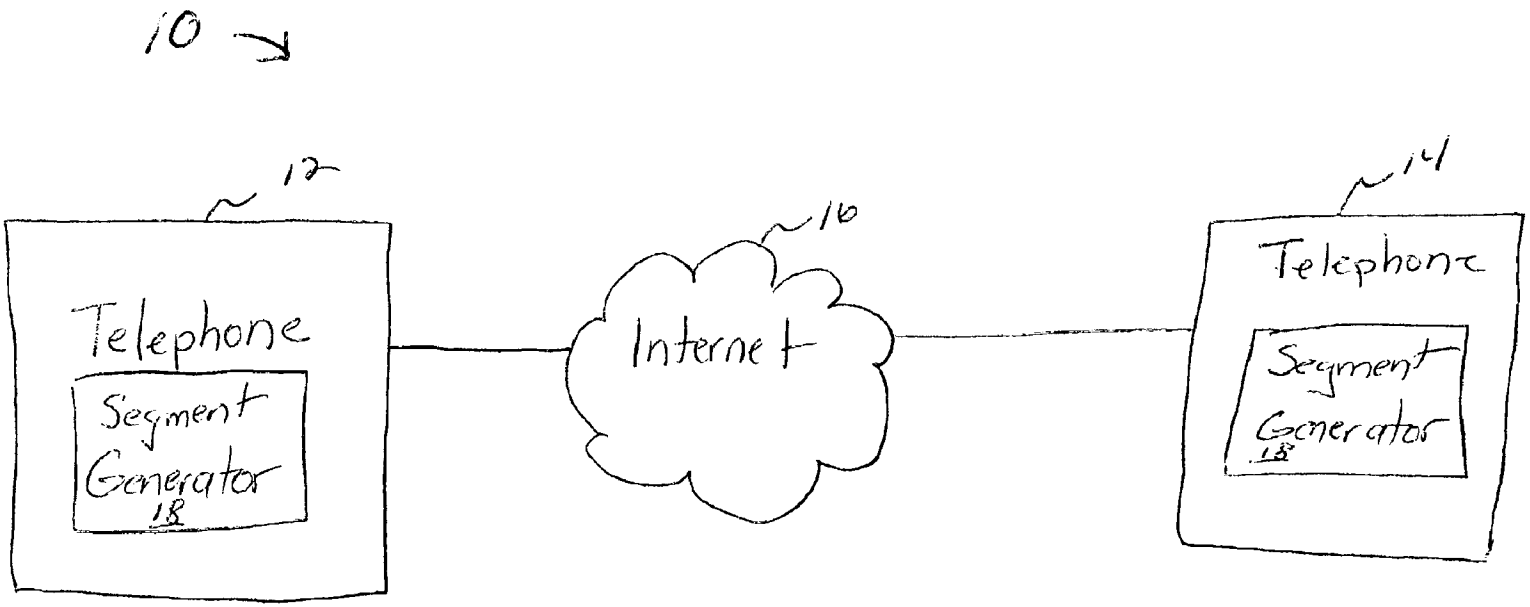
FIG. 1 schematically shows a preferred network arrangement in which two telephones transmit real-time voice signals across the Internet.

FIG. 1 schematically shows an exemplary data transfer network 10 that may utilize preferred embodiments of the invention. In particular, the network 10 includes a first telephone 12 that communicates with a second telephone 14 via the Internet 16. Each telephone includes a segment generator 18 that regenerates lost audio segments from previously received audio segments of an audio signal. As previously noted, a segment includes a plurality of audio samples. The segment generators 18 may be either internal or external to their respective telephones 12 and 14. In preferred embodiments, the segment generators 18 each include a computer system for executing conventional computer program code. Such computer system has each of the elements commonly utilized for such purpose, including a microprocessor, memory, controllers, etc . . . In other embodiments, the segment generators 18 are hardware devices that execute the functions discussed below with respect to FIGS. 3 and 4.

As noted above, the segment generators 18 utilize previously received audio segments to regenerate approximations of lost audio segments of a received audio signal. For example, the first telephone 12 may receive a plurality of Internet Protocol packets ("IP packets") transporting a given real-time voice signal from the second telephone 14. Upon analysis of the received IP packets, the first telephone 12 may detect that it had not received all of the necessary IP packets to reproduce the entire given signal. Such IP packets that were not received may have been lost during transmission, thus losing one or more audio segments of the given audio (voice) signal. As detailed below, the segment generator 18 of the first telephone 12 regenerates the missing one or more audio segments from the received audio segments to produce a set of regenerated audio segments. The set of regenerated audio segments, however, is an approximation of the lost audio segments and thus, is not necessarily an exact copy of such segments. Once generated, each segment in the set of regenerated audio segments is added to the given audio signal in its appropriate location, thus reconstructing the entire signal. If subsequent audio segments are similarly lost, the regenerated segment can be utilized to regenerate such subsequent audio segments.

It should be noted that two telephones are shown in FIG. 1 as a simplified example of a network 10 that can be utilized to implement preferred embodiments. Accordingly, principles of preferred embodiments of the invention can be applied to other network arrangements transporting packetized data between various network nodes. For example, the network 10 may be any public or private network utilizing known transport protocols, such as the aforementioned Internet Protocol, Asynchronous Transfer Mode, Frame Relay, and other such protocols. In addition to or instead of two telephones, the network 10 may include computer systems, audio gateways, or additional telephones. Moreover, the audio transmissions may be any type of audio transmission, such as a unicast, broadcast, or multicast of any known type of audio signal.

Figure 2:
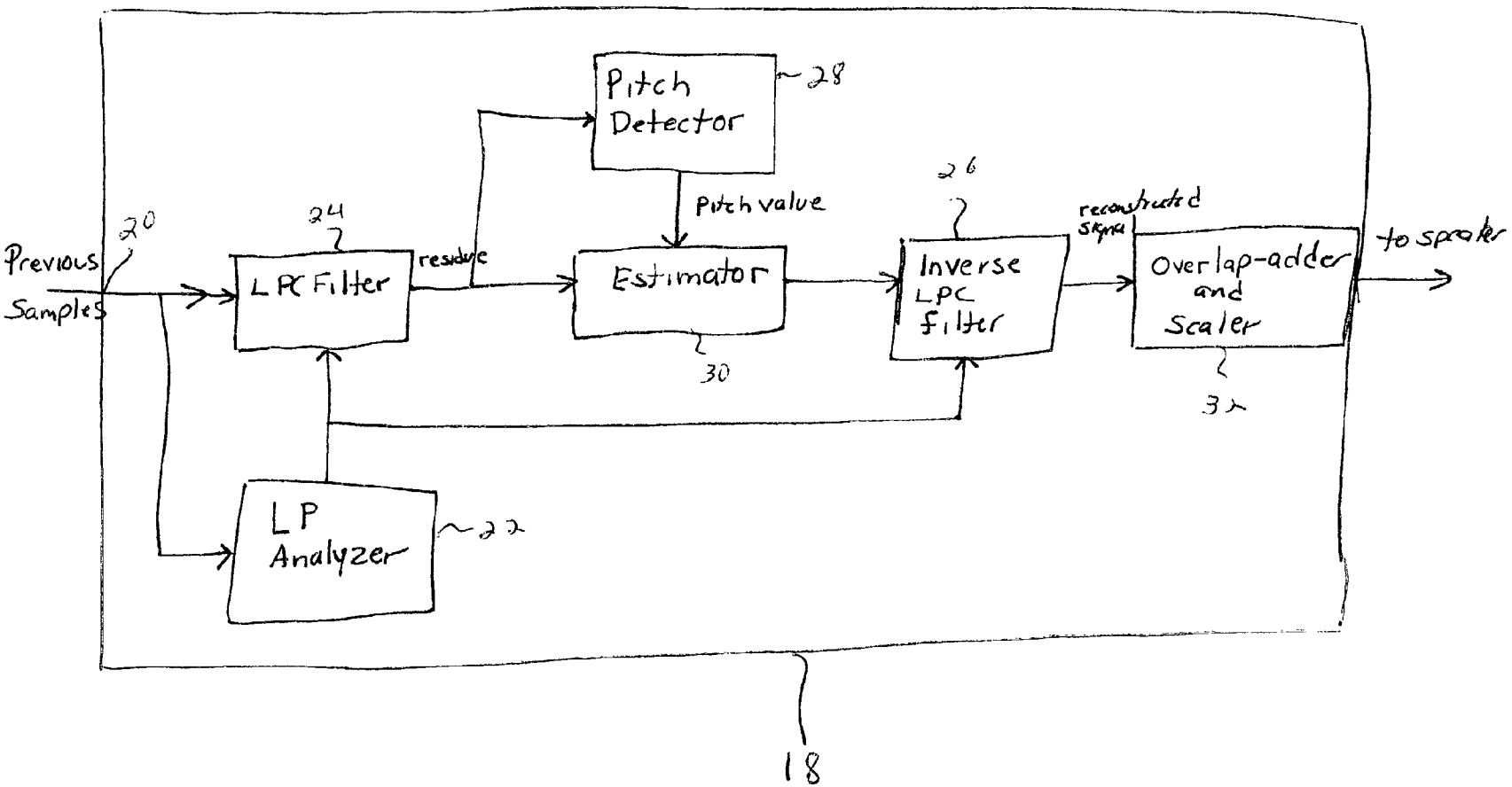
FIG. 2 schematically shows an audio segment generator configured in accord with preferred embodiments of the invention.
Figure 3:
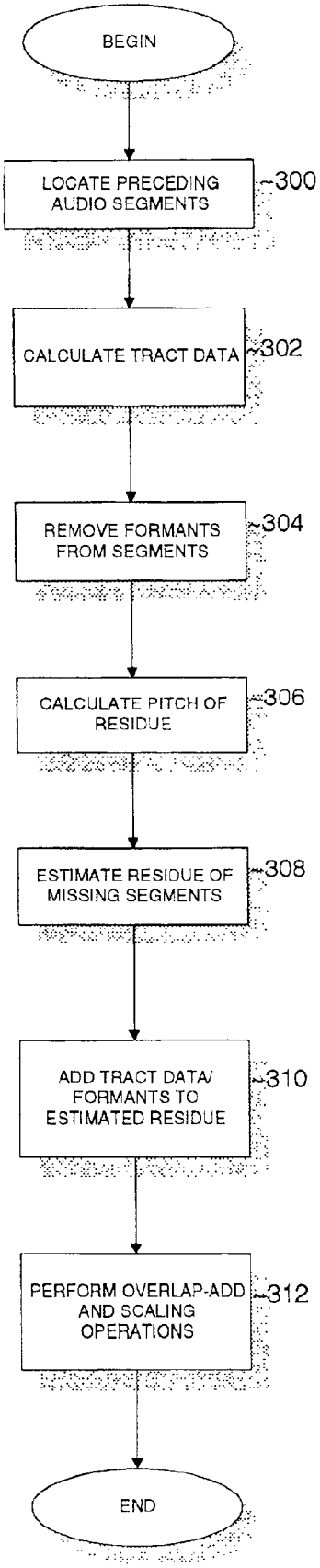
FIG. 3 shows a process of generating an audio signal in accord with preferred embodiments of the invention.

FIG. 2 schematically shows a segment generator 18 configured in accordance with preferred embodiments of the invention to execute the process shown in FIG. 3. Specifically, the segment generator 18 includes an input 20 that receives previous segments of the audio signal, and a linear predictive coding analyzer ("LP analyzer 22") that determines the characteristics of the formant of the received segments. The LP analyzer 22 preferably utilizes autocorrelation analysis techniques commonly employed in the voice signal processing field. The LP analyzer 22 consequently forwards the determined formant characteristics to a linear predictive filter ("LPC filter 24") that utilizes such characteristics to remove the formant from the input segments. In a similar manner, the LP analyzer 22 also forwards the determined formant characteristics to an inverse linear predictive filter ("inverse LPC filter 26") that restores the formant characteristics to a residue signal (a/k/a "residue segment(s)"). Both the LPC filter 24 and inverse LPC filter 26 utilize conventionally known methods for performing their respective functions.

In addition to the elements noted above, the segment generator 18 also includes a pitch detector 28 that determines the pitch of one or more residue segments, and an estimator 30 that utilizes the determined pitch and residue segments to estimate the residue segments of the lost audio segments being regenerated. An overlap-add module/scaling module 32 also are included to perform conventional overlap-add operations, and conventional scaling operations. In preferred embodiments, the pitch detector 28, estimator 30, and overlap-add/scaling module 32 each utilize conventional processes known in the art.

FIG. 3 shows a preferred process utilized by the segment generator 18 for regenerating the lost audio segment(s) of a real-time voice signal. This process makes use of the symmetric nature of a person's vocal tract over a relatively short time interval. More particularly, according to many well known conventions, a final voice signal is modeled as being a waveform traversing through a tube. The tube, of course, is a person's vocal tract, which includes the throat and mouth. When passing through the vocal tract, the waveform is modified by the resonances of the tract, thus producing the final voice signal. The effect of the vocal tract on the waveform thus is represented by the resonances that it produces. These resonances are known in the art as "formants." Accordingly, removing the formant from a final voice signal produces the original waveform, which is known in the art as a "residue" or a "residue signal." The residue signal may be referred to herein as a set of residue segments.

As known in the art, the audio signal is broken into a sequence of consecutive audio segments for transmission across an IP network. The process shown in FIG. 3 therefore is initiated when it is detected, by conventional processes, that one of the audio segments is missing from the received sequence of consecutive audio segments. The process therefore begins at step 300 in which a set of consecutive audio segments that precede the lost segment are retrieved. The set of retrieved audio segments preferably ranges from a one audio segment to fifteen audio segments. In alternative embodiments, each of the audio samples in the 60–70 milliseconds of the audio signal immediately preceding the lost audio sample should produce satisfactory results. The segment generator 18 may be preconfigured to utilize any set number of audio segments.

The set of audio segments preferably includes one or more audio segments that immediately precede the lost segment. A preceding audio segment in the audio signal is considered to immediately precede a subsequent audio segment when there are no intervening audio segments between the preceding and subsequent audio segments. The set of audio segments may be retrieved from a buffer (not shown) that stores the audio segments prior to processing.

Once the set of audio segments is retrieved, the process continues to step 302 in which the LP analyzer 22 calculates the tract data (i.e., formant data) from the set of segments. As noted above, the LP analyzer 22 utilizes conventional autocorrelation analysis techniques to calculate this data, and forwards such data to the LPC filter 24 and inverse LPC filter 26. The process then continues to step 304 in which the formants are removed from the input set of audio segments. To that end, the set of audio segments are filtered by the LPC filter 24 to produce a set of residue segments. The set of residue segments then are forwarded to both the estimator 30 and pitch detector 28.

Accordingly, the process continues to step 306 in which the pitch period of the set of residue segments is determined by the pitch detector 28 and forwarded to the estimator 30. In some embodiments, if the pitch detector 28 cannot adequately determine the pitch period of the set of residue segments, then it forwards the size of the lost audio segment to the estimator 30. The estimator utilizes this alternative information as pitch period information. Once received by the estimator 30, both the determined pitch period and the set of residue segments are processed to produce a new set of residue segments (a/k/a "residue signal") that approximate both a set of residue segments of the lost audio segments, and the residues of the two overlap segments that immediately precede and follow the lost audio segment (step 308).

Figure 4:
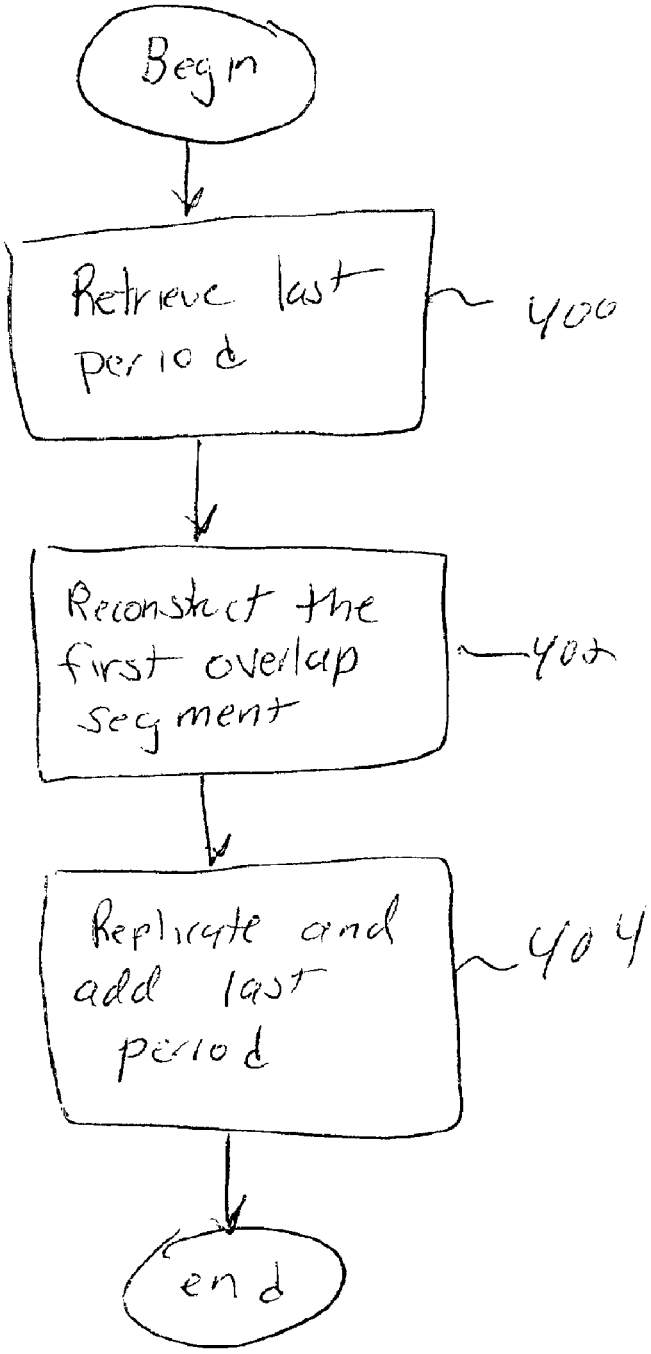
FIG. 4 shows a preferred process of estimating a set of residue segments of an audio signal.

The estimator 30 may utilize one of many well known methods to approximate the new set of residue segments. One method utilized by the estimator 30 is shown in FIG. 4. Such method begins at step 400 in which a set of consecutive samples having a size equal to the pitch period is retrieved from the end of the set of residue segments. For example, if the pitch period is twenty, then the estimator 30 retrieves the last twenty samples. Then, at step 402, the set of samples immediately preceding the set retrieved in step 400 is copied into the new residue signal. The size of the set copied at step 402 is equal to the size of the overlap segment that immediately precedes the lost audio segment. In the above example, if the size of the overlap segment is thirty, then thirty samples that immediately precede the last twenty samples are copied into the new residue signal. The process then continues to step 404 in which the set retrieved in step 400 is added as many times as necessary to the new residue signal to make the size of the new residue signal equal to the size of the lost audio segment, plus the sum of the sizes of the two overlap segments. Continuing with the above example, if the size of the lost audio segment is seventy and the size of the second overlap segment is thirty, then five replicas of the set retrieved in step 400 are added to the already existing thirty samples.

Returning to FIG. 3, once the estimator 30 generates the residue of the lost segments at step 308, the process continues to step 310 in which the vocal tract data is added back into the newly generated set of residue segments. To that end, the newly generated set of residue segments is passed through the inverse LPC filter 26, thus adding the formants of the initially calculated vocal tract. This produces a reproduced set of audio segments that approximate the lost set of audio segments.

The reproduced set of audio segments then may be further processed by the overlap-add/scaling module 32 by applying conventional overlap-add and scaling operations to the reproduced set. To that end, the middle portion of the reproduced audio signal/segments, which approximates the lost audio segment, is scaled and then used to replace the lost audio segment. The set of samples before the middle portion is overlapped with and added to the set of samples at the end of the set of audio segments retrieved at step 300, thus replacing those samples. The set of samples after the middle portion is discarded if the following audio segment also is lost. Otherwise, it is overlapped with and added to the set of samples at the beginning of the following audio segment, thus replacing those samples. In preferred embodiments, a conventionally known Hamming window is used in both overlap/add operations. Once the reproduced set of audio segments is generated, it immediately may be added to the audio signal, thus providing an approximation of the entire audio signal.

During testing of the discussed process, satisfactory results have been produced with signals having losses of up to about ten percent. It is anticipated, however, that this process can produce satisfactory results with audio signals having losses that are greater than ten percent. It should be noted that although real-time voice signals are discussed herein, preferred embodiments are not intended to be limited to such signals. Accordingly, preferred embodiments may be utilized with non-real time audio signals.

As suggested above, preferred embodiments of the invention may be implemented in any conventional computer programming language. For example, preferred embodiments may be implemented in a procedural programming language (e.g., "C") or an object oriented programming language (e.g., "C++"). Alternative embodiments of the invention may be implemented as preprogrammed hardware elements (e.g., application specific integrated circuits or digital signal processors), or other related components.

Alternative embodiments of the invention may be implemented as a computer program product for use with a computer system. Such implementation may include a series of computer instructions fixed either on a tangible medium, such as a computer readable media (e.g., a diskette, CD-ROM, ROM, or fixed disk), or transmittable to a computer system via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions preferably embodies all or part of the functionality previously described herein with respect to the system. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server or electronic bulletin board over the network (e.g., the Internet or World Wide Web).

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

I claim:

1. A method of generating a new audio segment for an audio signal, the audio signal having a plurality of audio segments, the method comprising:

receiving a stream of Internet Protocol (IP) packets, each IP packet encoding one of a plurality of segments of the audio signal;

determining that a given audio segment associated with an IP packet that is missing from the stream of IP packets is not ascertainable, the location of the given audio segment within the audio signal being ascertainable;

locating a set of consecutive audio segments in the audio signal, the set of consecutive audio segments decoded from IP packets in the stream immediately preceding the given audio segment and having a formant;

removing the formant from the set of audio segments to produce a set of residue segments having a pitch;

processing the pitch of the set of residue segments to produce a new set of residue segments; and adding the formant of the consecutive set of audio segments to the new set of residue segments to produce an output audio segment.

2. The method as defined by claim 1 wherein the audio signal is a voice signal transmitted across a packet based network.

3. The method as defined by claim 1 further comprising: determining the pitch of the set of residue segments.

4. The method as defined by claim 1 wherein the formant is removed by utilizing linear predictive coding filtering techniques.

5. The method as defined by claim 1 wherein the pitch of the set of residue segments are processed by utilizing linear predictive coding filtering techniques.

6. The method as defined by claim 1 wherein the formant is a function having a variable value across the set of audio segments.

7. The method as defined by claim 1 further comprising:

applying overlap-add operations to the output audio segment to produce an overlap audio segment.

8. The method as defined by claim 7 further comprising:

scaling the overlap audio segment to produce a scaled audio segment, the scaled audio segment being the new audio segment.

9. The method as defined by claim 1 further comprising:

adding the output audio segment to the audio signal in place of the given audio segment.

10. A computer program product for use on a computer system for generating a new audio segment for an audio signal, the audio signal having a plurality of audio segments, the computer program product comprising a computer usable medium having computer readable program code thereon, the computer readable program code including:

program code for converting a stream of Internet Protocol (IP) packets into a plurality of audio segments, including program code for identifying a missing IP packet in the stream of IP packets;

program code for determining that a given audio segment associated with the missing IP packet is not ascertainable, the location of the given audio segment within the audio signal being ascertainable;

program code for locating a set of consecutive audio segments in the audio signal, the set of consecutive audio segments associated with IP packets immediately preceding the missing IP packet corresponding to the given audio segment and having a formant;

program code for removing the formant from the set of audio segments to produce a set of residue segments having a pitch;

program code for processing the pitch of the set of residue segments to produce a new set of residue segments; and program code for adding the formant of the consecutive set of audio segments to the new set of residue segments to produce an output audio segment.

11. The computer program product as defined by claim 10 wherein the audio signal is a voice signal transmitted across a packet based network.

12. The computer program product as defined by claim 10 further comprising:

program code for determining the pitch of the set of residue segments.

13. The computer program product as defined by claim 10 wherein the program code for removing the formant comprising program code for utilizing linear predictive coding filtering techniques.

14. The computer program product as defined by claim 10 wherein the program code for processing includes program code for utilizing linear predictive coding filtering techniques.

15. The computer program product as defined by claim 10 wherein the formant is a function having a variable value across the set of audio segments.

16. The computer program product as defined by claim 10 further comprising:

program code for applying overlap-add operations to the output audio segment to produce an overlap audio segment.

17. The computer program product as defined by claim 16 further comprising:

program code for scaling the overlap audio segment to produce a scaled audio segment, the scaled audio segment being the new audio segment.

18. The computer program product as defined by claim 10 further comprising:

program code for adding the output audio segment to the audio signal in place of the given audio segment.

19. An apparatus for generating a new audio segment for an audio signal, the audio signal having a plurality of audio segments, the apparatus comprising:

logic for receiving a stream of Internet Protocol (IP) packets and translating the stream of IP packets into a plurality of audio segments;

a detector for determining that a given audio segment associated with a missing IP packet in the stream of IP packets is not ascertainable, the location of the given audio segment within the audio signal being ascertainable;

an input to receive a set of consecutive audio segments, the set of consecutive audio segments associated with IP packets immediately preceding the given audio segment;

a filter operatively coupled with the input, the filter removing the formant from the set of consecutive audio segments to produce a set of residue segments having a pitch;

a pitch detector operatively coupled with the filter, the pitch detector calculating the pitch of the set of residue segments;

an estimator operatively coupled with the pitch detector, the estimator producing a new set of residue segments based upon the set of residue segments and the calculated pitch; and an inverse filter operatively coupled with the estimator, the inverse filter adding the formant of the consecutive set of audio segments to the new set of residue segments to produce an output audio segment.

20. The apparatus as defined by claim 19 further comprising:

an analyzer operatively coupled with the input, the analyzer calculating formant values for generating the filter.

21. The apparatus as defined by claim 19 wherein the audio signal is a voice signal transmitted across a packet based network.

22. The apparatus as defined by claim 19 wherein the filter utilizes linear predictive coding filtering techniques.

23. The apparatus as defined by claim 19 wherein inverse filter utilizes linear predictive coding filtering techniques.

24. The apparatus as defined by claim 19 wherein the formant is a function having a variable value across the set of audio segments.

25. The apparatus as defined by claim 19 further comprising:

an overlap add module that applies overlap-add operations to the output audio segment to produce an overlap audio segment.

26. The apparatus as defined by claim 25 further comprising:

a scaler operatively coupled with the overlap add module, the scaler scaling the overlap audio segment to produce a scaled audio segment, the scaled audio segment being the new audio segment.

27. The apparatus as defined by claim 19 further comprising:

an adder that adds the output audio segment to the audio signal in place of the given audio segment.

28. The apparatus as defined by claim 19 wherein the set of consecutive audio segments immediately precede the given audio segment.

* * * * *